United States Patent [19]

Willer et al.

[11] Patent Number: 4,533,108

[45] Date of Patent: Aug. 6, 1985

[54] DRAFTING TABLE ATTACHMENT

[75] Inventors: David A. Willer, Welland; John Rosbak, Fonthill; Daniel G. McCombs, Port Colborne, all of Canada

[73] Assignee: Deere & Company, Moline, Ill.

[21] Appl. No.: 542,614

[22] Filed: Oct. 17, 1983

[51] Int. Cl.[3] ..... A47G 1/16

[52] U.S. Cl. ..... 248/467; 248/448; 248/469

[58] Field of Search ..... 248/467, 448, 469, 446, 248/244, 442.2, 295.1, 449; 312/233, 312; 108/28

[56] References Cited

U.S. PATENT DOCUMENTS

| | | | |
|---|---|---|---|
| 365,837 | 7/1887 | McGurrin | 248/448 |
| 943,091 | 12/1909 | Mills | 248/448 |
| 1,130,559 | 3/1915 | Allen | 248/442.2 |
| 1,990,104 | 2/1935 | Alstyne | 248/446 |
| 2,607,553 | 8/1952 | Garrett | 248/295.1 |
| 2,852,222 | 9/1958 | Bogar | 248/295.1 |
| 3,715,097 | 2/1973 | Kalajian | 248/449 |

*Primary Examiner*—Ramon S. Britts
*Assistant Examiner*—Ramon O. Ramirez

[57] ABSTRACT

Formed steel channel members mounted horizontally on vertical rods to the back of a drafting reference table. Two channel members are vertically adjustable to allow drawings, layouts and the like of different dimensions to be conveniently located and supported, and a third channel member serves to prevent material from slipping off the back of the table.

11 Claims, 3 Drawing Figures

Fig. 1
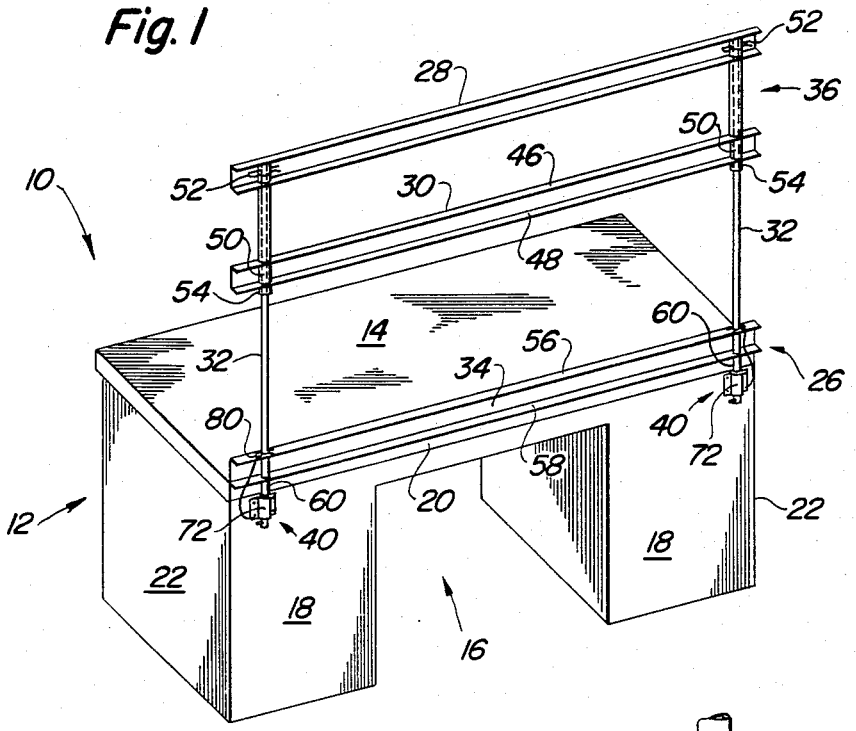
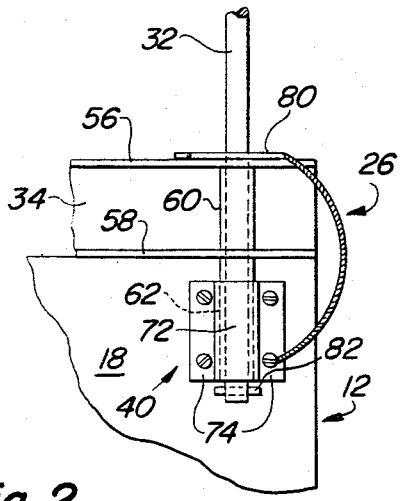
Fig. 2
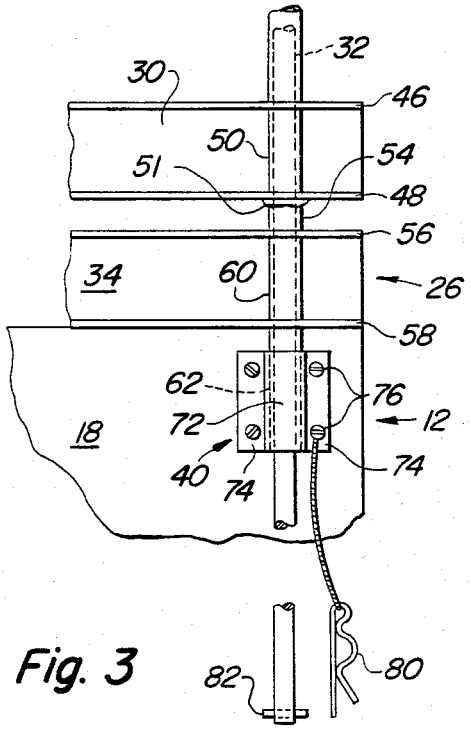
Fig. 3

DRAFTING TABLE ATTACHMENT

BACKGROUND OF THE INVENTION

The present invention relates to work supports such as desks and tables, and more specifically to an assembly for supporting drawings, layouts and other reference items adjacent a desk or table.

Engineers, designers and draftsmen or the like in the course of their work must frequently refer to existing drawings, layouts and/or other papers, some of which are too large to spread out on conventional reference tables provided at work stations. At the same time, it is often necessary for such personnel to refer to other materials such as technical data or standards, thereby putting a premium on available working space. Productivity is reduced as a result of the inability of presently available work supports to conveniently receive and support all the necessary materials in an organized and compact manner. Alleviating shortages of working space has typically required adding desks or tables, or expanding existing desk or table surfaces, either of which increases office space necessary to accommodate the personnel. When tables or desks are added, they usually must be shared and cannot be located conveniently for all to use.

SUMMARY OF THE INVENTION

It is therefore an object of the present invention to provide an improved structure for organizing drawings, layouts and the like adjacent a desk or table.

It is another object of the present invention to provide work support structure to conveniently receive and support materials in an organized and compact manner to thereby increase productivity of personnel at their desks or tables. It is a further object to provide such a structure which may be utilized without requiring additional office floor space.

It is yet another object to provide a compact, inexpensive adjustable work station attachment for drafting tables and desks or the like. It is another object to provide such an attachment which eliminates need to provide additional tables or desks which must be shared and cannot be conveniently located.

It is still a further object of the invention to provide an attachment which prevents paper and material from sliding off a reference table and permits drawings, layouts and the like, too large or numerous to be received by the table, to be conveniently located for easy access. It is another object to provide such an attachment which does not substantially hinder consultation across the reference table.

In accordance with the above objects, an assembly fabricated from horizontal steel channel members mounted on vertical rods is attached to the back of a desk or drafting table. The rods can be extended or retracted above the level of the table surface to move the channel members up or down to accommodate drawings and papers of different sizes. The materials are releasably secured to the members by button magnets or the like. The rods are pinned to hold the members at the desired height. An additional channel member can be installed at table top level to prevent material from sliding off the back of the table.

The assembly is compact and inexpensive, and can be used at each individual work station to increase productivity without increasing office space requirements. Many different sizes and types of papers and drawings can be supported for convenient reference by the individual without cluttering the work surface of his table. The additional channel member at table top level is particularly helpful when the back of the reference table is on an aisle way or against a wall. The assembly has a minimum amount of structure so that consultation is not hindered, and the adjustable portion of the assembly can be completely removed by removing locking pins from the lower end of the vertical rods.

These and other objects, features and advantages of the present invention will become apparent to those skilled in the art from the description which follows and from the drawings.

BRIEF DESCRIPTION OF THE DRAWINGS

FIG. 1 is a perspective view showing the rear of a desk or table with the assembly of the present invention attached and adjusted to its uppermost position.

FIG. 2 is an enlarged view of the support bracket area of one side of the desk shown in FIG. 1.

FIG. 3 is a view similar to FIG. 2, but with the assembly adjusted to the lowermost position.

DESCRIPTION OF THE PREFERRED EMBODIMENT

A conventional drafting reference desk or table, indicated generally at 10 in FIG. 1, includes a base portion 12 supporting a horizontally disposed work surface 14 in a conventional manner. The base 12 includes a centrally located opening 16 for accommodating a chair under the work surface 14 at the front side of the desk. The base 12 includes rear upright walls 18 which extend vertically from the floor to rear edge 20 of the work surface 14. Sidewalls 22 extend forwardly from the rear walls 18 to the front side of the desk 10. The rear edge 20 lies approximately in the vertical plane defined by the upright walls 18.

The attachment of the present invention, indicated generally at 26, includes upper and intermediate channel members 28 and 30 which open rearwardly and are supported in horizontal and parallel relationship on upright rods 32. A lowermost channel-shaped member 34 is supported at the rear edge 20 of the work surface 14. In the preferred embodiment, the member 28 is fixed to the member 30 by hollow tubes 50 to form a substantially rigid assembly 36. The two rods 32 are inserted into the tubes 50 and fixed thereto by spring pins 52. The assembly 36 with the rods 32 attached is adjustably mounted for vertical movement as a unit with respect to the lower member 34 and the work surface 14 by a pair of rod support brackets 40.

Referring now also to FIGS. 2 and 3 for a more detailed description of the attachment 26, the intermediate channel-shaped member 30 includes upper and lower rearwardly directed flanges 46 and 48. Near each of the ends of the intermediate member 30, vertically aligned holes are provided in the flanges 46 and 48 which receive a section of the tube 50 which is welded to the member at 51 and extends a short distance below the lower flange 48 to an end 54. Preferably, the tube 50 extends upwardly from the member 30 through the lower flange of the upper member 28. The corresponding rod 32 is fixed within the tube 50 by the pin 52 passing through the rod and tube between the flanges of the member 28. By removing the pins 52, the rods 32 may be removed from the assembly 36 for compact storage when the attachment 26 is not needed.

The lowermost channel-shaped member 34 includes upper and lower rearwardly directed flanges 56 and 58. A separate tube 60 passes through each of the ends of the members and is secured thereto in similar manner as that described with respect to the tube 50 and the member 30. The tube 60 includes a lower end 62 which extends below the flange 58 a sufficient distance for attachment by the bracket 40 to the back 18 of the desk. Each of the rods 32 is slidably received within the corresponding tube 60 so that the rigid assembly 36 can be moved up and down while maintaining the members 28 and 30 substantially parallel to the floor.

Each of the brackets 40 is formed from sheet metal and includes a rounded channel portion 72 which receives the lower end 62 of the tube 60. Flanges 74 extend outwardly from the portion 72 and are attached flatly against the wall 18 by screws 76 to fix each tube 60, and thereby the member 34, to the rear of the desk 10. The member 34 preferably abuts against the work surface 14 and extends above the surface to prevent material from falling off the back of the desk.

The members 28 and 30 are maintained substantially horizontal and are vertically spaced a distance which is comparable to the length of standard notebook or typing paper. The assembly 36 may be fully extended (FIGS. 1 and 2) for holding large drawings and other large documents by sliding the rods 32 upwardly in the brackets 40. Spring pins 80 tethered to the brackets 40 are inserted through holes in the rods 32 to support the assembly 36 in the position shown in FIG. 1. By removing the pins 80, the assembly 36 may be positioned as shown in FIG. 3 with the member 30 spaced slightly above the member 34 by the tube ends 54 to prevent pinched fingers as the assembly is lowered. In the lowermost position of FIG. 3, the lower ends of the rods 32 are closely adjacent the floor to maximize the range of adjustment of the assembly 36. A removable retaining pin 82 is located at the lower end of each of the rods 32 to prevent the assembly 36 from inadvertently being removed from the brackets 40 as it is raised to the uppermost position. The entire assembly 36 may be lifted from the brackets 40 and removed from the desk 10 by removing the pins 82. The member 34 may remain connected to the desk 10 by the brackets 40, and provides a neat, compact rear stop which easily receives the rigid assembly 36 when document support becomes necessary.

When an individual is referring to a large document such as a layout drawing, the assembly 36 is secured in the fully extended or uppermost position of FIG. 1, and the document is attached by button magnets or spring clips to the members 28 and 34 to permit the top 14 of the desk 10 to accommodate other materials and tools. When reference to smaller documents such as letters and small drawings is necessary, the assembly 36 may be lowered to an intermediate position by inserting the pins 80 into an appropriate pair of apertures in the rods 32, or the pins 80 may be removed completely so that the assembly 36 may be adjusted to its lowermost position (FIG. 3) with the tube ends 54 resting on the flange 56 of the member 34.

The attachment 26 is relatively sturdy and yet provides a minimum amount of structure so that consultation across the back of the desk 10 is virtually unhindered. The front faces of the channel-shaped members 28, 30 and 34 lie in a vertical plane so that both large and small documents may be neatly supported in line with the rear edge of the desk to conserve space.

Having described the preferred embodiment, it will be apparent that modifications can be made without departing from the scope of the invention as defined in the accompanying claims.

We claim:

1. In a desk having a generally horizontal work surface with front and rear edges and a base extending downwardly from the work surface for supporting the surface above the floor, said base including a rear wall generally aligned with the rear edge, an upright document holder, comprising: a pair of upright rods, first and second rigid transverse members connected to the rods and extending therebetween in generally parallel, vertically spaced relationship, said transverse members transversely spacing the vertical rods and maintaining them in substantially fixed relationship with the uppermost transverse member defining the upper extremity of the holder, said rods including lower portions extending downwardly in parallel relationship from the lowermost transverse member, wherein the length of the lower portions of the rods are substantially greater than the vertical space between the first and second transverse members, bracket means connected to the desk and slidably receiving the lower portions of the rods for adjustably supporting transverse members above the rear edge of the work surface, means for securing the rods in a preselected adjusted vertical position relative to the work surface, and wherein the upright rods and transverse members form a rigid assembly movable with respect to the bracket means between a lowermost position wherein the ends of the lower portions of the rods are closely adjacent the floor and an upper position wherein said ends of said portions are positioned adjacent the work surface.

2. The invention as set forth in claim 1 wherein the transverse members comprising channel-shaped beams, each having a forwardly directed face with upper and lower rearwardly facing flanges, and wherein the upright rods extend through the flanges and support the beams with the faces lying substantially in a vertical plane which passes adjacent the rear edge.

3. The invention as set forth in claim 2 further including a rearwardly opening channel-shaped member secured to the rear of the desk and including a front face positioned adjacent to the rear edge and extending above the work surface, said last-mentioned member including rearwardly directed flanges slidably receiving therethrough the lower portions of the rods.

4. The invention as set forth in claim 2 wherein the beams are metal, and wherein the document holder further comprises magnetic clip means for attaching the document to the forwardly directed face of at least one of the beams.

5. The invention as set forth in claim 1 further including selectively attachable and removable retaining means located at the lower ends of the rods for when attached preventing the rods from sliding upwardly out of the bracket means while when removed permitting the rods to be removed from the brackets.

6. The invention as set forth in claim 3 wherein the bracket means comprises an upright tube secured to the channel-shaped member and extending downwardly through the lower flange of said member to the rear wall of the desk and an attaching member securing the lower end of the upright tube to the rear wall, and wherein one of the rods is slidably received within the tube.

7. The invention as set forth in claim 6 including means for providing a space between the channel-shaped member and the lowermost channel-shaped beam, when the rods are adjusted to the lowermost position, said means including a tubular portion extending around one of the rods between the lower flange of said lowermost beam and the upper flange of said channel-shaped member.

8. The invention as set forth in claim 7 wherein said space between the member and beam when the rods are adjusted to the lowermost position is substantially less than the space between the first and second transverse members.

9. The invention as set forth in claim 1 wherein the transverse members are rigidly connected by a pair of transversely spaced upright tubes, and wherein said upright rods extend through the upright tubes.

10. The invention as set forth in claim 9 wherein the rods are selectively removable from the upright tubes for compact storage.

11. The invention as set forth in claim 9 wherein said upright tubes include a lower end extending downwardly from the lowermost transverse member for providing a space between said member and the work surface when the transverse members are adjusted to their lowermost position.

* * * * *